United States Patent [19]

Levine

[11] Patent Number: 4,821,366

[45] Date of Patent: Apr. 18, 1989

[54] WET-DRY VACUUM CLEANER

[75] Inventor: Morris M. Levine, Scarsdale, N.Y.

[73] Assignee: CIC Int'l. Corp., New York, N.Y.

[21] Appl. No.: 189,810

[22] Filed: May 3, 1988

[51] Int. Cl.[4] ..... A47L 5/24

[52] U.S. Cl. ..... 15/344; 15/339; 15/353

[58] Field of Search ..... 15/344, 350, 353, 339

[56] References Cited

U.S. PATENT DOCUMENTS

| | | | |
|---|---|---|---|
| 2,539,867 | 1/1951 | Schnabel | 183/22 |
| 3,627,511 | 8/1966 | Meyerhoefer | 15/353 |
| 3,939,527 | 2/1976 | Jones | 15/320 X |
| 4,367,565 | 1/1983 | Parise | 15/353 X |
| 4,536,914 | 8/1985 | Levine | 15/344 |
| 4,542,557 | 9/1985 | Levine | 15/344 |

*Primary Examiner*—Chris K. Moore

*Attorney, Agent, or Firm*—Charles E. Baxley

[57] ABSTRACT

A wet-dry vacuum cleaner includes a housing assembly providing a cavity, a motor within the cavity, and an impeller driven by the motor to produce a vacuum. A canister has an intake nozzle for recepton of dirt, liquid, and air drawn into the nozzle by the vacuum. The nozzle has an air intake port and a downwardly facing air exit port within the canister. A filter assembly is largely within the canister and provides an air flow path from the nozzle to the impeller. The filter assembly includes a tubular filter holder having a large diameter rear end sealingly engaging the end of the canister remote from the nozzle and a front end spaced a substantial distance forwardly from the rear end and a filter intake element within the canister and in communication with the filter holder.

10 Claims, 2 Drawing Sheets

WET-DRY VACUUM CLEANER

BACKGROUND OF INVENTION

This invention relates to vacuum cleaners and more particularly to vacuum cleaners capable of operating with either air or with air and liquid and still more particularly to a portable hand held wet-dry vacuum cleaner which is operable over a wide range of angular orientations while satisfactorily handling liquid as the cleaning medium.

The wet-dry vacuum cleaner of the present invention is an improvement over the inventions of my prior U.S. Pat. Nos. 4,536,914 and 4,542,557 which issued Aug. 27, 1985 and Sept. 24, 1985, respectively. Those patents disclose portable, hand-held wet-dry vacuum cleaners which are generally capable of handling liquid as the cleaning medium over a wide range of angular orientations. The present invention also performs that same function, but does so in a different and improved manner.

My prior Pat. No. 4,542,557 discloses a wet-dry vacuum cleaner comprising a housing and a canister removably affixed to the front end thereof, and a handle at the back end thereof. The housing contains a blower or impeller, and a shaft imparts rotation to the blower to create a partial vacuum which draws air into the housing. The canister has a nozzle with an air intake port or spout at the end of the canister remote from the housing and an exit port and a diverter within the canister. A conduit which is located forwardly of and axially diagonal with the blower has an entry port located at the region of an interface between the housing and the canister, and an air filter covers the entry port for entrapping particulate matter which might otherwise be drawn into the conduit by the passage of air toward the blower. Air so drawn into the conduit passes the blower and is exhausted from the housing via exhaust vents at the bottom of the housing. Covering the opposite side of the filter from the conduit is an inlet chamber having an entry port with an opening which is laterally offset with respect to the diverter. The part of the interior of the canister which is forward of the filter and which is otherwise unoccupied provides a storage chamber, and the diverter diverts incoming liquid into the storage chamber, away from the air entry port opening, so that incoming liquid (with entrained dirt) is deflected away from the flow of the air stream which goes through the filter. When the vacuum cleaner is operated in the angular orientation with the air inlet opening of the nozzle facing vertically upwardly, the effective volume of the storage chamber is reduced to the volume thereof below the opening of the air entry port. If the liquid level were to rise above the air entry port opening, the liquid would enter, by gravity, into the inlet chamber, would pass through the filter and into the blower. From there, some of the liquid would pass out through the exhaust vents, creating a very messy situation, and some of the liquid would gain access to the motor, thus possibly shortening the life of the motor and causing danger of electrical shock to the user.

The present invention overcomes the aforesaid problem of the prior art in a manner which is at the same time simple and inexpensive.

Accordingly, it is an important object of the present invention to provide a portable, hand-held wet-dry vacuum cleaner which affords improved performance in the liquid mode when held in the angular orientation in which the air inlet opening of the nozzle faces vertically upwardly.

It is a further object of the present invention to provide a portable, hand-held wet-dry vacuum cleaner which achieves the aforesaid improved performance in a manner which is at the same time simple and inexpensive, not adding appreciably, if at all, to the cost of manufacturing the wet-dry vacuum cleaner according to the invention.

Other objects and advantages of the invention will become apparent hereinafter.

SUMMARY OF THE INVENTION

A wet-dry vacuum cleaner in accordance with the invention comprises a housing assembly providing a cavity, a motor within the cavity, an impeller driven by the motor to produce a vacuum, and a canister having an intake nozzle for reception of dirt, liquid, and air drawn into the nozzle by the vacuum. The nozzle has an air intake port and an air exit port within the canister. A filter assembly is largely within the canister and provides an air flow path from the nozzle to the impeller. The filter assembly includes an elongated tubular filter holder having a large diameter rear end sealingly engaging the end of the canister remote from the nozzle and a front-end spaced a substantial distance forwardly from the rear end. A filter intake element is within the canister and is in communication with the filter holder.

DESCRIPTION OF THE INVENTION

Figure 2:
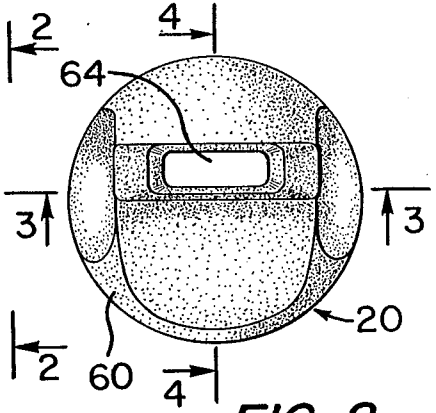
FIG. 2 is a view on line 2—2 of FIG. 1.
Figure 1:
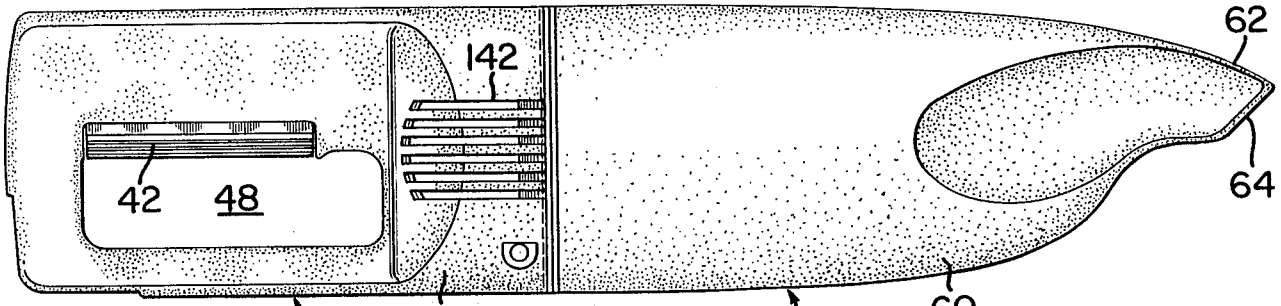
FIG. 1 is side elevation of a portable wet-dry vacuum cleaner which is a preferred embodiment of the invention.

The invention will initially be described with reference to FIGS. 1-4 which show a portable, hand-held, wet-dry vacuum cleaner 20 which is a preferred embodiment of the invention. Vacuum cleaner 20 comprises a housing assembly 22 having mating left and right housing halves 24 and 26, respectively, which are essentially mirror images of each other and which are held together by screws 28. Housing halves 24 and 26 provide a cavity containing four batteries 30, an electric motor 32 held in place on a motor bracket 34 by two fixing screws, one of which is visible at 36. Batteries 30 are connected by known electrical circuitry (not shown) to motor 32, a slide switch 38, an indication L.E.D. 40 and a switch cap 42, whereby motor 32 can be operated or shut off as desired. Motor 32 has a shaft 44 which rotates when motor 32 is operated and a fan-like blower or impeller 46 is mounted on shaft 44 to rotate therewith.

Figure 4:
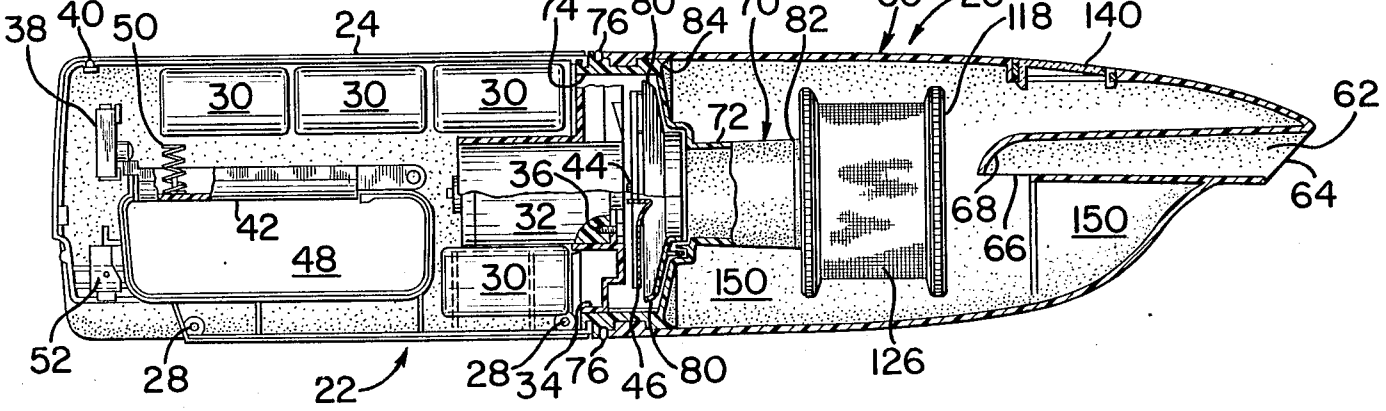
FIG. 4 is a view substantially on line 4—4 of FIG. 2.

Housing halves 24 and 26 are shaped to form an opening 48 therethrough to receive a user's fingers from one side and thumb from the other side, thus to provide means for easy and comfortable holding of vacuum cleaner 20 during use. FIG. 4 also shows vacuum cleaner 20 as having a compression spring 50 and an input jack 52 within the cavity provided by housing halves 24 and 26 and adjacent the rear end of opening 48. The spring 50 acts to restore the trigger switch cap 42 to its normal off position after pressure on the cap is released by the user. The jack 52 provides an entry for the recharging mechanism (not shown) in order to recharge the vacuum cleaner 20 after it is used.

Vacuum cleaner 20 further comprises an elongated canister 60 which at its front-end has a nozzle 62 with an air intake port or spout 64 and a downwardly facing air exit port 66. A diverter 68 is positioned at the air exit port 66 and serves to divert solid particulate matter and/or liquid toward the lower end side walls of canister 60, in known fashion.

Figure 3:
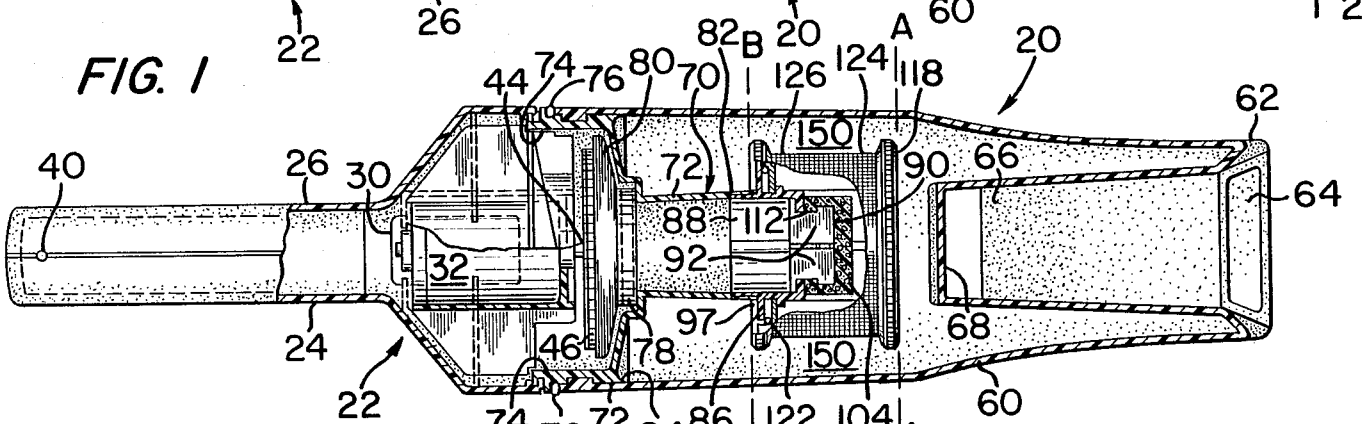
FIG. 3 is a view substantially on line 3—3 of FIG. 2.

A filter assembly indicated generally at 70 in FIGS. 3 and 4 is located largely within canister 60 and between diverter 68 and the end of canister 60 remote from spout 64. Filter assembly 70 includes a generally tubular filter holder 72 having a large diameter rear end 74 which releasably engages the front-end of housing assembly 22 and also releasably engages the end of canister 60 remote from spout 64 with a resilient sealing ring 76 therebetween. Within filter holder 72 and in engagement therewith as indicated at 78, as est seen in FIG. 3, is an impeller or blower cover 80 which partially overlies impeller or blower 46. Filter holder 72 extends from rear end 74 to a front end 82 which is spaced a substantial longitudinal dimension toward diverter 68 from rear end 74 and from impeller or blower 46. Furthermore, holder 72 is provided with a circumferentially continuous concavely-dished surface 84 facing away from housing assembly 22 and engaging the inner wall of canister 60.

Figure 5:
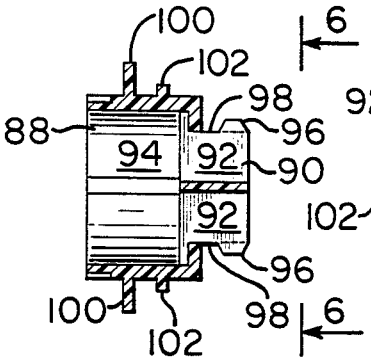
FIG. 5 is an axial sectional view of a connector which is a component of a filter assembly incorporated in the vacuum cleaner of FIG.1.
Figure 6:
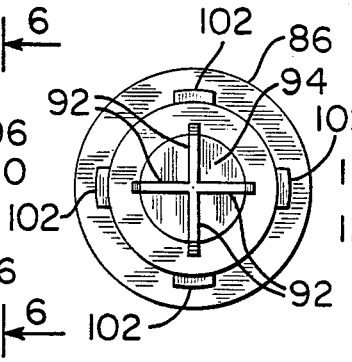
FIG. 6 is a view on line 6—6 of FIG. 5.

Filter assembly 70 further includes a one-piece tubular connector 86 (FIGS. 3, 5 and 6) having a rear end 88 in overlapping engagement with front-end 82 of filter holder 72. Connector 86 also has a forward end 90 with four thin blades 92 radiating outwardly from the axis of connector 86 and perpendicular to each other, leaving an axial air passage 94 past blades 92 and extending from end-to-end of connector 86. The radially outer portions of blades 92 are provided with similar bulges 96, leaving undercut portions 98 rearwardly of bulges 96. Also, connector 86 has an external circumferential flange 100 and four similar external projections 102 evenly spaced circumferentially and located axially between flange 100 and blades 92.

Figure 7:
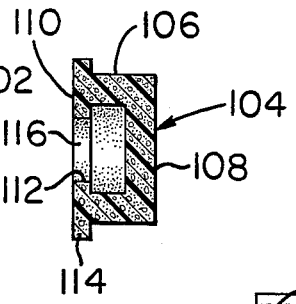
FIG. 7 is an axial sectional view of a sponge filter which is another component of the filter assembly.
Figure 8:
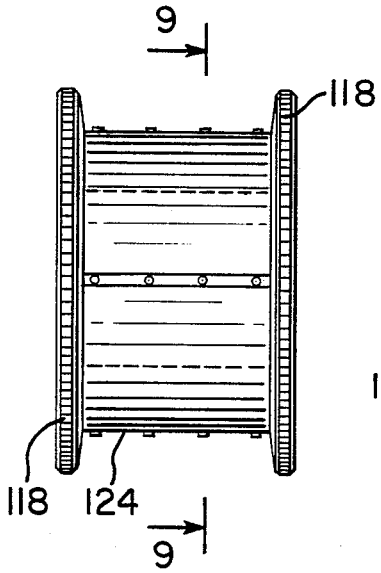
FIG. 8 is an elevation of a filter intake which is another component of the filter assembly.

In addition, filter assembly 70 has a spongy rubber-like filter 104 (FIGS. 3 and 7) having a body portion 106 providing filter 104 with a closed end 108 and a flange portion 110 with an internal flange 112 and an external flange 114, internal flange 112 providing filter 104 with an open end 116. Filter 104 is shown assembled in FIG. 3 with connector 86, with blades 92 within filter 104, and with bulges 96 overlapping internal flange 112. Filter 104 can be installed by hand on connector 86 and removed therefrom by hand.

Figure 9:
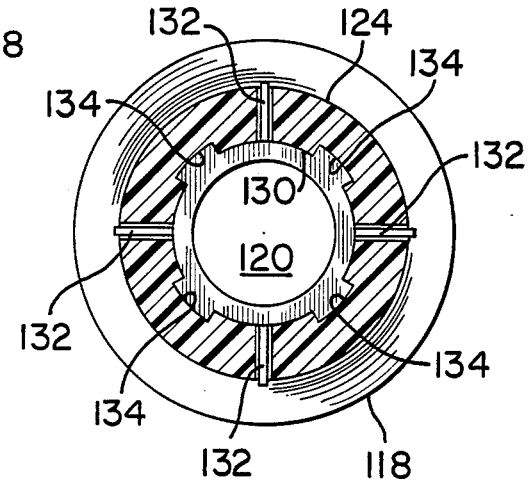
FIG. 9 is a sectional view on line 9—9 of FIG. 8.
Figure 10:
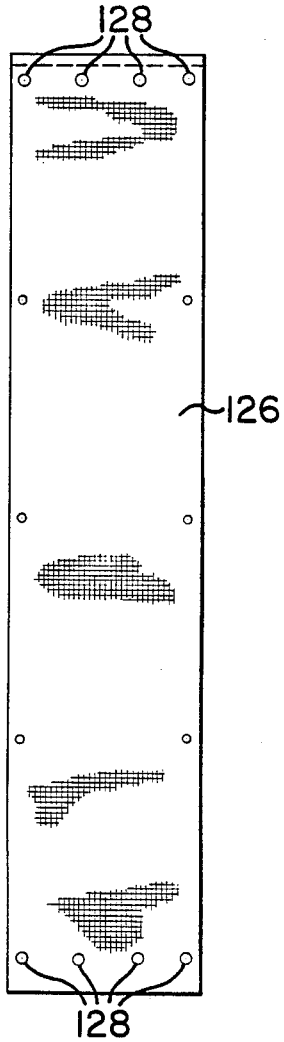
FIG. 10 is plain view of a gauze filter which is an additional element of the filter assembly.

Filter assembly 70 further includes a spool-like filter intake element 118 (FIGS. 3, 4, 8 and 9) having an axial opening 120 from end-to-end thereof, as best seen in FIG. 9, for reception therein of filter 104 and the front end of connector 86. External flange 100 engages one axial end face of intake element 118 with a sealing ring 122 therebetween, as shown in FIG. 3. Element 118 has an external cylindrical surface 124, and a filter element 126 (FIGS. 4 and 10) which is of stainless steel gauze and which in the flat condition (shown in FIG. 10) is rectangular. The filter element is assembled on intake element 118 by wrapping it around surface 124 and suitably fastening it to itself, making use of holes 128 near the ends of element 126.

Axial opening 120 of element 118 has an enlarged portion 130 shown in FIG. 9 and a plurality of radial vent passages 132 are in open communication with surface 124 and enlarged portion 130 to permit the flow of air through filter element 126 to the interior of filter intake element 118. Enlarged portion 130 of axial opening 120 has four similar further enlarged portions 134 which are circumferentially localized to receive projections 102 of connector 86, which projections 102 overlap radial edges of enlarged portions 134 to prevent connector 86 from rotating with respect to filter intake element 118.

Vacuum cleaner 20 also has, in the top of canister 60, directly above nozzle 62, a window 140 mounted in a hole through the wall of canister 60. Window 140 permits visual examination of the interior of canister 60 to determine when it is necessary or desirable to remove canister 60 from the remainder of vacuum cleaner 20 for cleaning.

Many components of vacuum cleaner 20 may be of suitable plastic material , such as acrylonitrile-butadiene styrene (ABS). These components include housing halves 24 and 26, motor bracket 34, blower or impeller 46, canister 60, filter holder 72, impeller or blower cover 80, connector 86 and filter intake element 118.

It is apparent that the portion of the interior of canister 60 which is forward or upstream of dished surface 84 of filter holder 72 and not otherwise occupied by components of vacuum cleaner 20, provides vacuum cleaner 20 with a storage chamber 150 (FIGS. 3 and 4) for liquid and solid particulate matter.

Vacuum cleaner 20 provides a path for air-flow therethrough, entering canister 60 through spout 64 and nozzle 62 and past diverter 68 and into storage chamber 150. From there, the air flow path goes into filter intake element 118, both axially into opening and radially through gauze filter element 126 and through radial vent passages 132. From there, the air path goes through filter 104, through connector 86, through filter holder 72, past impeller or blower cover 80, and past impeller or blower 46. Then the air finds egress from vacuum cleaner 20 through exhaust vents 142.

FIG. 3 shows a line A—A coincident with the forward of filter intake element 118, and a line B—B coincident with the rearward end of element 118, denoting two parallel transverse planes. The volume of storage chamber 150 forward of line A—A is less than the volume of storage chamber 150 rearward of line B—B.

If vacuum cleaner 20 is used to pick up a liquid, such liquid, along with solid particulate matter, is drawn into storage chamber 150, being directed by diverter 68 away from filter assembly 70. This feature is by itself not new, being disclosed in my said prior U.S. Pat. No. 4,542,557, which is described above. However, vacuum cleaner 20 includes a number of features which result in improved handling of liquids with respect to the devices of that prior patent. These features can be used separately or together, it being noted that the greatest benefits are obtained by utilizing all of those features together. The benefits referred to are realized particularly in the situation in which vacuum cleaner 20 is operated in the angular orientation with the air intake port or spout 64 of nozzle 62 facing generally vertically upwardly.

One of the improved features referred to is that air opening 120 in filter intake element 118 is located substantially forward of impeller or blower 46, so as to increase the volume of liquid which may be introduced into storage chamber 150 before it can spill into the direct path to impeller or blower 46. Another improved feature is dished surface 84 of filter holder 72 which creates a moat or saucer effect permitting liquid to settle around fitter opening 120 and not into it.

Because the liquid is directed away from filter opening 120, the liquid will not go into opening 120 even if vacuum cleaner 20 is turned or jostled at an angle.

To prevent unwanted liquid leakage out of vacuum cleaner 20, the liquid storage capacity when cleaner 20 is held in a downward position is less than the liquid storage capacity on the left or right side, or in the upward position. This is the significance of the fact that, as stated above, the volume of storage chamber 150 forward of line A—A is less than the volume of storage chamber rearward of line B—B.

It is apparent that the invention achieves the stated objects and advantages and others.

The disclosed details are exemplary only and are not to be taken as limitations on the invention except as those details may be included in the appended claims.

What is claimed is:

1. A wet-dry vacuum cleaner comprising a housing assembly providing a cavity, a motor within said cavity, an impeller driven by said motor to produce a vacuum, a canister having an intake nozzle for reception of dirt, liquid and air drawn into said nozzle by said vacuum, said nozzle having an air intake port and an air exit port within said canister, and a filter assembly largely within said canister and providing an air flow path from said canister to said impeller, said filter assembly including a tubular filter holder having a large diameter rear end sealingly engaging an end of said canister remote from said nozzle and a front end spaced a substantial distance forwardly from said rear-end, a tubular filter intake element within said canister and having an opening from end to end thereof in communication with said air flow path of said filter holder, and means positioned in the vicinity of said air exit port of said nozzle for deflecting the dirt and liquid drawn into said nozzle away from said opening of said intake element.

2. The vacuum cleaner according to claim 1 wherein said large diameter rear end of said filter holder includes a concavely-dished surface toward said nozzle.

3. The vacuum cleaner according to claim 1 further comprising a tubular connector having a rear end engaging said front end of said filter holder and a forward end located within said filter intake element and a spongy rubber-like filter removably assembled with said forward end of said connector.

4. The vacuum cleaner according to claim 3 wherein said forward end of said connector has radial blades with an air passage therebetween, the radially outer portions of said blades having similar bulges with undercut portions rearwardly of said bulges, and said spongy filter having a body portion with a closed end and a flange portion with an internal flange providing said spongy filter with an open end, said bulges of said connector overlapping said internal flange to hold said spongy filter in place on said connector.

5. The vacuum cleaner according to claim 3 wherein said filter intake element has an external surface with vent passages connecting said opening and said external surfaces and said vacuum cleaner further comprises a guaze filter element wrapped around said external surface.

6. The vacuum cleaner according to claim 5 wherein the portion of the interior of said canister unoccupied by said filter assembly provides a storage chamber and said filter intake element has a forward end and a rearward end and the volume of said storage chamber forward of said forward end of said filter intake element is less than the volume of said storage chamber rearward of said rearward end of said filter intake element.

7. The vacuum cleaner according to claim 1 wherein said filter intake element has an external surface with vent passages connecting said opening and said external surface, and said vacuum cleaner further comprises a gauze filter element wrapped around said external surface.

8. The vacuum cleaner according to claim 1 wherein said canister has a window above said air exit port of said nozzle.

9. The vacuum cleaner according to claim 1 wherein said impeller is within said rear end of said filter holder and said vacuum cleaner further comprises an impeller cover within said rear end of said filter holder.

10. The vacuum cleaner according to claim 1 wherein said means for deflecting comprises a downwardly facing extension of said air exit port.

* * * * *